US006499161B1

(12) United States Patent
Godette

(10) Patent No.: US 6,499,161 B1
(45) Date of Patent: Dec. 31, 2002

(54) ADJUSTABLE BED WITH VIBRATORS

(75) Inventor: Robert G. Godette, Midway City, CA (US)

(73) Assignee: L&P Property Management Company, South Gate, CA (US)

( * ) Notice: Subject to any disclaimer, the term of this patent is extended or adjusted under 35 U.S.C. 154(b) by 156 days.

(21) Appl. No.: 09/657,113

(22) Filed: Sep. 7, 2000

(51) Int. Cl.[7] ..... A61G 7/015; A61H 7/00

(52) U.S. Cl. ..... 5/618; 5/933; 601/56; 601/59; 601/60

(58) Field of Search ..... 5/618, 613, 933; 601/49, 56, 58, 59, 60

(56) References Cited

U.S. PATENT DOCUMENTS 5,140,977 A * 8/1992 Raffel ..... 5/915
5,577,280 A 11/1996 Elliott ..... 5/618
6,006,379 A 12/1999 Hensley ..... 5/618
6,101,647 A 8/2000 Stroud et al. ..... 5/618
6,115,861 A 9/2000 Reeder et al.

* cited by examiner

*Primary Examiner*—Alexander Grosz
(74) *Attorney, Agent, or Firm*—Wood, Herron & Evans, L.L.P.

(57) ABSTRACT

An adjustable bed having an upper frame mounted to translate with respect to a lower frame. A center support is connected to the upper frame and has a head support pivotally connected to one end thereof. A thigh support is pivotally connected to the other end of the center support and a foot support is connected to the other end of the thigh support. The bed includes an improved mounting for a massage motor in which a resonator board is mounted on resilient spacers on an upper surface of a support platform.

18 Claims, 2 Drawing Sheets

ADJUSTABLE BED WITH VIBRATORS

FIELD OF THE INVENTION

This invention relates generally to beds and more particularly, to improvements to beds.

BACKGROUND OF THE INVENTION

Adjustable beds have been used for many years to permit the user to adjust the head and foot sections of the bed to different positions. While originally only manually adjustable, more recently, the head and foot sections are moved by motors operated by the user via a remote control.

Adjustable beds were originally designed principally for use in medical environments by patients who had to spend long periods of time in bed for reasons of health, injury, etc. However, more recently, adjustable beds are also being used in residential environments by users who have no health or physical impairment. An increasing number of people place televisions and other entertainment devices in the bedroom, and more time is spent lounging in bed. Hence, the bed, and in particular, an adjustable bed, is considered by many users an alternative piece of leisure furniture. As the market for leisure beds grows, there is continuing effort by suppliers to provide leisure beds that are more comfortable, have more options, for example, massage capabilities, more sophisticated controls, and are more affordable.

One recent development in adjustable beds is the development of a "wallhugger" adjustable bed. The wallhugger adjustable bed maintains the user in the same position with respect to adjacent appliances and furniture as the head portion of the bed is moved between flat and elevated positions. To achieve that purpose, as the head section pivots upward, an upper bed frame portion translates toward the head end of the bed with respect to a stationary lower bed frame section.

Almost all adjustable beds utilize one or more massage motors which are controllable by a user to provide a massaging action while the user is in the bed. In one embodiment, a massage motor is rigidly connected to an underside of a rigid platform, for example, a head board or a foot board, that is hinged to a center board or platform. Further, the whole articulated platform normally supports a mattress base, for example, a foam pad approximately 4 inches thick, over which is placed beneath a mattress. Thus, any vibration applied to the underside of the head board must vibrate the whole head board; and further, the vibration is partially absorbed and attenuated by the soft materials in the mattress base and the mattress. The resulting or net vibration applied to a user lying on the mattress is often substantially less than is desired. In other designs, the massage motor is rigidly mounted to a resonator board that is inserted into a centrally located slit and cutout portion of the mattress base. The resonator board is then bonded to an interior surface within the slit in the mattress base, and the massage motor extends downward through the cutout in the mattress base and a contiguous cutout in the platform supporting the mattress base and the mattress. As with the former design, the vibrating action of the massage motor is substantially attenuated by the thick foam mattress base.

Thus, there is a need for an improved bed structure for more effectively transmitting massaging actions or vibrations from a massage motor to a user lying on the bed.

SUMMARY OF THE INVENTION

The present invention provides a bed having an improved massage capability, thereby increasing the satisfaction of the user with the bed. The bed of the present invention is especially useful when used with an adjustable bed in which multiple massage motors are used.

According to the principles of the present invention and in accordance with one embodiment, the bed of the present invention has a bed frame and a support section supported by the bed frame and adapted to support a user. The bed further has a resonator board nonrigidly mounted to an upper surface of the support section, and a massage motor mounted to the resonator board. This massage mounting structure greatly improves the transmission of vibrations created by the massage motor to a user.

In accordance with one aspect of the invention, the bed has a mattress base having a thickness of approximately one inch for covering the support section. In accordance with another aspect of the invention, the resonator board is resiliently mounted to the upper side of the support section; and the massage motor is mounted to a lower side of the resonator board. Thus, the resonator board is mounted such that vibrations from the massage motor are transmitted to the user with a minimum of attenuation by the foam mattress base and the mattress.

These and other objects and advantages of the present invention will become more readily apparent during the following detailed description taken in conjunction with the drawings herein.

DETAILED DESCRIPTION OF THE INVENTION

Figure 1:
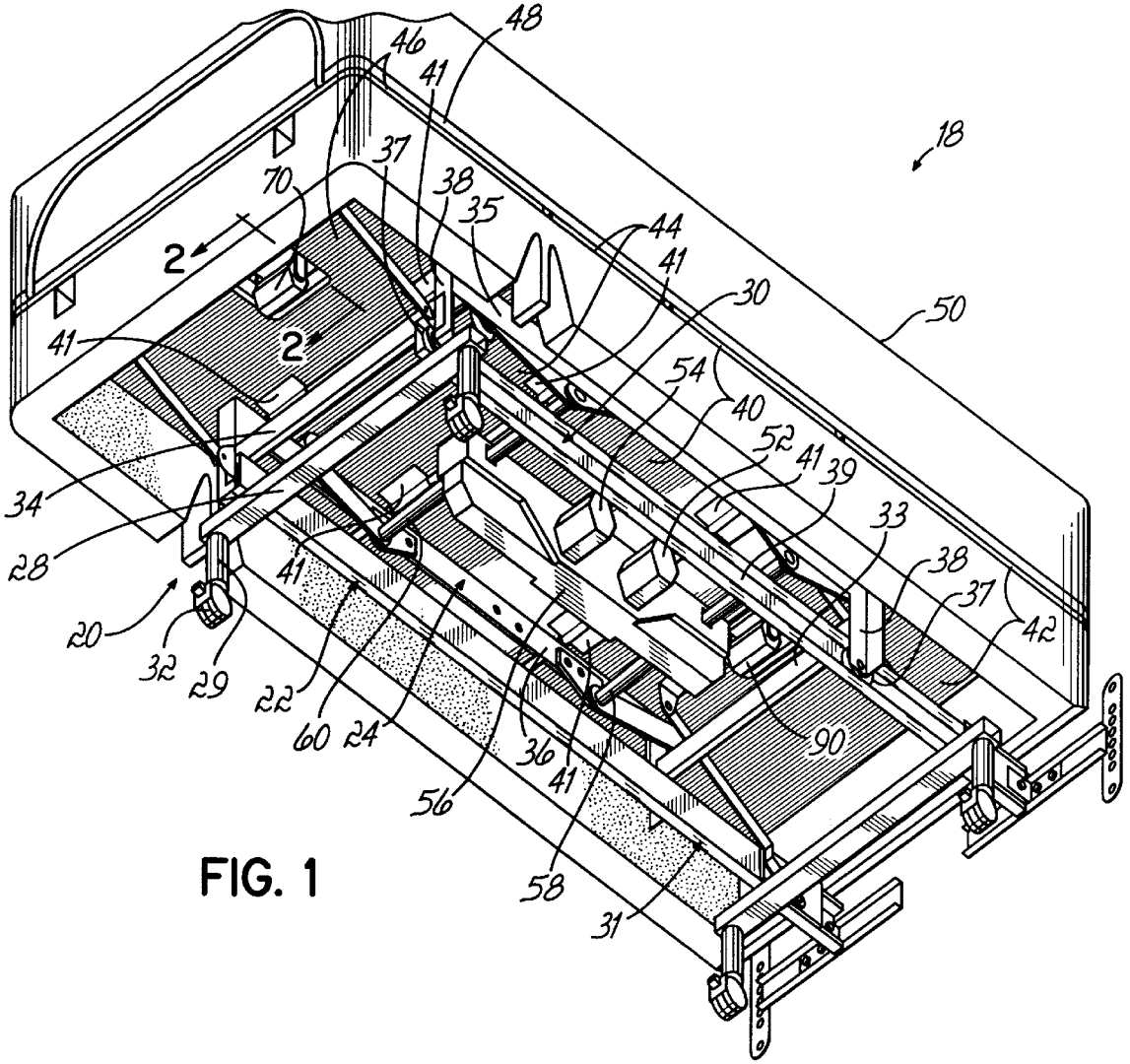
FIG. 1 is a perspective view of an adjustable bed with associated mattress components in accordance with the principles of the present invention.

Referring to FIG. 1, an adjustable bed 18 includes a bed frame 24 compnised of a lower frame 22 and an upper frame 24 movably mounted on the lower frame 22. The lower frame 22 has head and foot end rails 26, 283 respectively, and left and right side rails 30, 31 respectively. The rails 26–31 are joined at their ends to form a generally rectangular frame section. Each of the casters 32 includes a caster bracket 29 for receiving the stem of the caster (not shown) that supports the adjustable bed 18 on the floor. The upper frame 24 includes a head rail 33, a foot rail 34 and left and right side rails 35, 36, respectively. The rails 33–36 are rigidly connected at their ends with fasteners to form the generally rectangular upper frame 24. The upper frame side rails 35–36 are made of angle stock, and the upper frame 24 is movably mounted on the lower frame 22 by four wheels 37 which are rotatably mounted to the ends of legs 38. The wheels 37 ride in C-shaped channels or tracks 39 forming the left and right lower frame side rails 30, 31, respectively.

In a known manner, a center support board or platform 40 is connected to the upper frame 24, and a head support board or platform 42 is pivotally connected to a head end of the center supporting platform 40 with hinges 41. A thigh support board or platform 44 is pivotally connected to a foot end of the center support platform 40 by hinges 41; and a foot supporting board or platform 46 is pivotally connected to a foot end of the thigh supporting platform 42 by hinges 41. The supporting platforms 40–46 may be made from any desired material that is capable of properly supporting a user on a mattress, for example, a plywood or oriented strand board ("OSB") material. The supporting platforms 40–46 are normally 0.625 inch thick but may be other thicknesses as is required. A mattress base 48, for example, a one inch foam pad, is mounted over and covers the head, center, thigh and foot support boards 40–46. Normally, the boards 40–46 and mattress base 48 are enclosed within a covering (not shown). A mattress 50 is then laid over the mattress base 48.

Head and thigh motors 52, 54, respectively, are mounted to a drive assembly 56 which mechanically couples the head and thigh motors 52, 54 to respective head and thigh torque tubes 58, 60 in a known manner. Operating the head motor 52 rotates the torque tube 58 and raises the head platform 42. With the bed of FIG. 1, as the head platform 42 is raised, the upper frame 24 translates toward the head end the bed; and the head platform 42 remains close to the headboard 117. Operating the thigh motor 54 rotates the thigh torque tube 60 and raises the junction of the thigh and foot platforms 44, 46, respectively.

Figure 2:
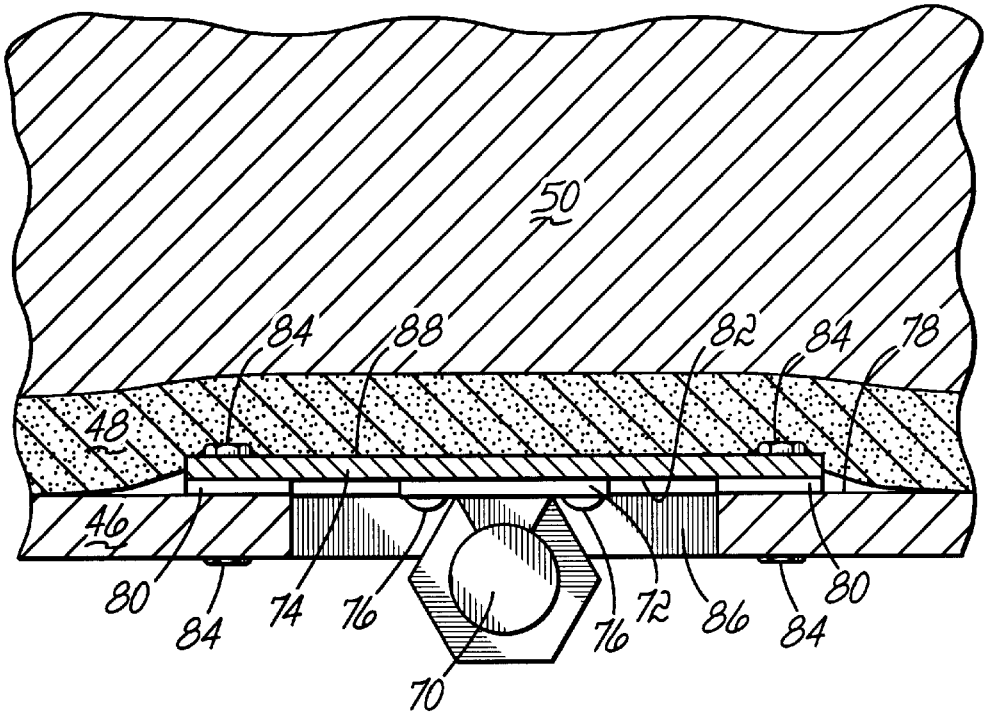
FIG. 2 is a partial cross-sectional view taken along line 2—2 of FIG. 1 and illustrates a massage motor mounting in accordance with the principles of the present invention.

Referring to FIG. 2, a massage motor 70 has a base plate 72 that is rigidly connected to a resonator board 74 by fasteners 76. The resonator board 74 is any rigid structure to which the massage motor 70 may be attached, for example, 0.250 inch plywood or OSB. The resonator board is mounted with respect to an upper surface 78 of the foot platform 46. Resilient spacers 80 are located between the upper surface 78 of the foot platform 46 and a lower surface 82 of the resonator board 74. Fasteners 84 extend through contiguous holes in the foot platform 46, the spacers 80 and the resonator board 74. The fasteners 84 may be any suitable fastener, for example, a threaded screw or bolt and a mating nut. The massage motor 70 which is mounted on a lower surface 82 on the resonator board 74 extends through an opening 86 within the foot platform 46. The mattress base 48 is placed over the upper surface 78 of the foot platform 46 as well as the upper surface 88 of the resonator board 74.

When the message motor 70 is turned on, it transfers its vibrations to the resonator board 74. Since the resonator board is not rigidly fixed to the foot platform 46, the resonator board 74 is relatively free to oscillate or vibrate within the constraints permitted by the resilient spacers 80. The resilient spacers 80 permit the resonator board 74 to supply a substantially greater vibration to the mattress base 48 than would otherwise be possible if the resonator board 74 were rigidly connected to the foot platform 46. The spacers 80 are flexible or soft enough to permit the resonator board 74 to vibrate freely and minimize the transfer of vibrations from the massage motor 70 to the foot platform 46. However, the spacers 80 are hard or rigid enough so that, when the bed is loaded to its maximum limit, that is, with a large person, the resonator board does not make contact with the foot platform 46. Any contact between the resonator board 74 and the foot platform 46 results in an undesirable and distracting vibrating noise. Typically, the spacers 80 are made from a neoprene material and have a rating in the range of from approximately 20 to approximately 30 using a Shore A durometer.

The mattress base 48 simply lays over the upper surface 78 of the support platform 46 and the upper surface 88 of the resonator board 74. The mattress base functions to dampen the feeling of the irregularities in the top surfaces 78 and the resonator board 74 caused by fasteners, for example, fasteners 84 and the fasteners used to connect the hinges 41 to the supporting platforms 40–46. The mattress base 48 can be made of any soft material such as a fiber or foam, for example, a one inch thick urethane foam having a density of approximately 1.8 and an I.L.D. of from approximately 30 pounds to approximately 35 pounds. While the mattress base 48 in nominally 1 inch thick, it can have a thickness in the range of from approximately 0.500 inch to approximately 3 inches.

Thus, with the massage motor mounting illustrated in FIG. 2, the vibrations of the massage motor 70 are much less dampened by the mattress base 48 and more effectively transferred to a user resting on the mattress 50. In FIG. 2, the mounting of the motor 70 was described with respect to the foot platform 46. As will be appreciated, the mounting of massage motor 90 (FIG. 1) with respect to the head platform 40 is identical to that described in FIG. 2. Thus, the mounting of the massage motor 70 as illustrated in FIG. 2 may be used with respect to any of the bed platform sections 40–46. The bed 18 of the present invention provides a simpler and less expensive construction that provides a more effective massage action.

While the invention has been illustrated by the description of one embodiment and while the embodiment has been described in considerable detail, there is no intention to restrict nor in any way limit the scope of the appended claims to such detail. Additional advantages and modifications will readily appear to those who are skilled in the art. For example, the massage motor mounting of FIG. 2 and cover 92 of FIG. 1 are described with respect to a "wallhugger" adjustable bed. As will be appreciated, the same massage motor mounting and cover 92 may be applied to other adjustable bed designs which are not of the "wallhugger" type. In addition, where appropriate, for example, where a platform construction is used instead of a box spring, the same massage motor mounting and cover 92 may be applied to nonadjustable bed designs.

In the described embodiment with respect to FIG. 1, massage motors are attached to the head platform 42 and the foot platform 46, as will be appreciated, the massage motor mounting of FIG. 3 may be used with massage motors mounted to the thigh platform 44 or the center platform 40.

Further, the massage motor 70 is described as being rigidly mounted to the resonator board, however, as will be appreciated, in some applications, it may be desirable to nonrigidly mount the massage motor 70 to the resonator board using a spacer made of a compressible material. The massage motor 70 is also described as being mounted to a lower side of the resonator board 74. As will be appreciated, with other massage motors and/or applications, it may be desirable to mount the massage motor 70 to the upper side of the resonator board 74.

Therefore, the invention in its broadest aspects is not limited to the specific detail shown and described. Consequently, departures may be made from the details described herein without departing from the spirit and scope of the claims which follow.

What is claimed is:

1. An adjustable bed comprising:

a bed frame;

a center support section supported by the bed frame;

a second support section having one end pivotally attached to one end of the center support section, the second support section having an upper side and a lower side;

a resonator board nonrigidly mounted to the upper side of the second support section;

a neoprene spacer mounted between the upper side of the second support section and the resonator board; and a massage motor mounted to the resonator board.

2. The adjustable bed of claim 1 further comprising a mattress base having a thickness of approximately one inch covering the center and second support sections.

3. The adjustable bed of claim 1 further comprising a mattress base having a thickness in the range of from approximately 0.500 inch to approximately 3 inches.

4. The adjustable bed of claim 1 wherein the resonator board has an upper side and a lower side and the massage motor is mounted to a lower side of the resonator board.

5. The adjustable bed of claim 4 wherein the massage motor is nonrigidly mounted to the resonator board.

6. The adjustable bed of claim 1 wherein the second support section comprises:

a thigh support section having one end pivotally connected to the opposite end of the center support section; and a foot support section having one end pivotally connected to an opposite end of the thigh center support section and the massage motor is nonrigidly mounted to the foot support section.

7. The adjustable bed of claim 1 wherein the second support section is a head support section and the massage motor is nonrigidly mounted to the head support section.

8. The adjustable bed of claim 1 further comprising:

a third support section having one end in mechanical communication with an opposite end of the center support section;

a second resonator board nonrigidly mounted to the third support section; and a second massage motor mounted to the second resonator board.

9. The adjustable bed of claim 8 further comprising a fourth support section having one end pivotally connected to the opposite end of the center support section and another end pivotally connected to an end of the third support section.

10. An adjustable bed comprising:

a bed frame;

a center support section supported by the bed frame;

a second support section having one end pivotally attached to one end of the center support section, the second support section further having an opening therethrough, a resonator board nonrigidly mounted to the second support section, the resonator board having an upper side and a lower side; and a massage motor nonrigidly mounted to the lower side of the resonator board and extending through the opening in the second support section from the lower side of the resonator board.

11. The adjustable bed of claim 10 wherein the second support section has an upper side and a lower side and the resonator board is nonrigidly mounted to the upper side.

12. The adjustable bed of claim 11 wherein the resonator board is resiliently mounted to the upper side of the support section.

13. The adjustable bed of claim 10 further comprising a mattress base having a thickness of approximately one inch covering the center and second support sections.

14. The adjustable bed of claim 10 further comprising a mattress base having a thickness in the range of from approximately 0.500 inch to approximately 3 inches.

15. The adjustable bed of claim 10 wherein the second support section comprises:

a thigh support section having one end pivotally connected to the opposite end of the center support section; and a foot support section having one end pivotally connected to an opposite end of the thigh center support section and the massage motor is nonrigidly mounted to the foot support section.

16. The adjustable bed of claim 10 wherein the second support section is a head support section and the massage motor is nonrigidly mounted to the head support section.

17. The adjustable bed of claim 10 further comprising:

a third support section having one end in mechanical communication with an opposite end of the center support section;

a second resonator board nonrigidly mounted to the third support section; and a second massage motor mounted to the second resonator board.

18. The adjustable bed of claim 17 further comprising a fourth support section having one end pivotally connected to the opposite end of, the center support section and another end pivotally connected to an end of the third support section.

* * * * *